US008955270B2

(12) United States Patent
Markham

(10) Patent No.: US 8,955,270 B2
(45) Date of Patent: Feb. 17, 2015

(54) WINDOW ASSEMBLIES INCLUDING BRONZE ELEMENTS

(71) Applicant: Olmos Scofield, LLC, San Antonio, TX (US)

(72) Inventor: Trevor Markham, San Antonio, TX (US)

(73) Assignee: Olmos Scofield, LLC, San Antonio, TX (US)

( * ) Notice: Subject to any disclaimer, the term of this patent is extended or adjusted under 35 U.S.C. 154(b) by 0 days.

(21) Appl. No.: 13/838,269

(22) Filed: Mar. 15, 2013

(65) Prior Publication Data

US 2013/0312343 A1 Nov. 28, 2013

Related U.S. Application Data

(60) Provisional application No. 61/647,796, filed on May 16, 2012.

(51) Int. Cl.

| | |
|---|---|
| ***E06B 3/988*** | (2006.01) |
| ***E06B 3/54*** | (2006.01) |
| ***E06B 1/36*** | (2006.01) |
| ***E06B 3/12*** | (2006.01) |

(52) U.S. Cl.

CPC ..... *E06B 3/5454* (2013.01); *E06B 1/366* (2013.01); *E06B 3/12* (2013.01)

USPC ..... 52/204.71; 52/204.69; 52/204.595

(58) Field of Classification Search

CPC ..... E06B 2003/26312; E06B 2003/26389; E06B 2003/6223; E06B 2003/6226

USPC ..... 52/204.69, 204.71, 204.591, 476, 775, 52/204.61, 204.62, 204.593, 204.595

See application file for complete search history.

(56) References Cited

U.S. PATENT DOCUMENTS

| | | | | | |
|---|---|---|---|---|---|
| 2,219,688 | A | * | 10/1940 | Knudsen | 52/208 |
| 2,288,548 | A | * | 6/1942 | Peremi et al. | 52/204.53 |
| 3,071,215 | A | * | 1/1963 | Gall | 52/395 |
| 3,233,381 | A | * | 2/1966 | Von Wedel | 52/775 |
| 3,527,011 | A | * | 9/1970 | Bloom et al. | 52/204.593 |
| 4,001,994 | A | * | 1/1977 | Williams et al. | 52/204.597 |
| 4,187,657 | A | * | 2/1980 | Sukolics | 52/204.591 |
| 4,309,845 | A | * | 1/1982 | Schmidt | 49/501 |

(Continued)

*Primary Examiner* — James Ference

(74) *Attorney, Agent, or Firm* — Jackson Walker, LLP

(57) ABSTRACT

A window for engagement with a building structure having a window opening, the window is providing a perimeter frame adapted to engage the window opening of the structure. The window has at least one window pane having a window pane perimeter. The window uses multiple perimeter retainer members including an outer perimeter retainer member and an inner perimeter retainer member, the perimeter retainer members typically having opposed substantially flat walls configured to engage the outer pane surface and the inner pane surface, respectively, and perimeter clip member engaging walls. Holding the retainer members are perimeter clip members configured with a first end and a second end, at least the first end adapted to resiliently engage at least one of the perimeter retainer members and a second end to engage the other retainer member so as to maintain the retainers in spaced apart relation with the flat walls thereof flush against walls adjacent the window pane perimeter. There may be resilient sealing members adapted to engage the flat walls of the retainer members to seal the same against the window panes, the perimeter frame adapted to engage the perimeter clip members so as to hold the inner and outer perimeter retainer members fixedly adjacent the frame.

11 Claims, 6 Drawing Sheets

(56) References Cited

U.S. PATENT DOCUMENTS

| | | | | | |
|---|---|---|---|---|---|
| 4,428,171 | A * | 1/1984 | Harbin | 52/204.593 |
| 4,432,179 | A * | 2/1984 | Bachmann | 52/204.593 |
| 4,447,985 | A * | 5/1984 | Weber et al. | 49/400 |
| 4,495,726 | A * | 1/1985 | Lindstrom | 49/401 |
| 4,614,062 | A * | 9/1986 | Sperr | 49/504 |
| 4,845,911 | A * | 7/1989 | Winston et al. | 52/456 |
| 5,044,121 | A * | 9/1991 | Harbom et al. | 49/401 |
| 5,088,255 | A * | 2/1992 | Emanuel | 52/395 |
| 5,214,877 | A * | 6/1993 | Kaspar et al. | 49/70 |
| 5,373,671 | A * | 12/1994 | Roth et al. | 52/204.1 |
| 5,379,518 | A * | 1/1995 | Hopper | 29/897.312 |
| 5,481,839 | A * | 1/1996 | Lang et al. | 52/235 |
| 5,570,548 | A * | 11/1996 | Hopper | 52/204.5 |
| 5,617,684 | A * | 4/1997 | Sheath | 52/204.57 |
| 5,617,695 | A * | 4/1997 | Brimmer | 52/717.02 |
| 6,141,925 | A * | 11/2000 | Halvorson et al. | 52/238.1 |
| 6,438,913 | B1 * | 8/2002 | Ishikawa et al. | 52/235 |
| 6,536,182 | B2 * | 3/2003 | France | 52/786.1 |
| 6,662,523 | B2 * | 12/2003 | Hornung et al. | 52/786.13 |
| 6,898,914 | B2 * | 5/2005 | Folsom et al. | 52/656.8 |
| 6,974,518 | B2 * | 12/2005 | Hornung et al. | 156/109 |
| 7,036,280 | B2 * | 5/2006 | Hogan | 52/235 |
| 7,065,929 | B2 * | 6/2006 | Manzella et al. | 52/204.1 |
| 7,765,751 | B2 * | 8/2010 | Vukovic et al. | 52/204.595 |
| 2002/0121071 | A1 * | 9/2002 | Heung-Bin | 52/800.11 |
| 2002/0189743 | A1 * | 12/2002 | Hornung et al. | 156/109 |
| 2003/0024182 | A1 * | 2/2003 | Yeany | 52/204.67 |
| 2003/0221381 | A1 * | 12/2003 | Ting | 52/204.1 |
| 2003/0230034 | A1 * | 12/2003 | Lapierre | 52/204.5 |
| 2006/0185273 | A1 * | 8/2006 | Lathief | 52/204.71 |
| 2006/0218875 | A1 * | 10/2006 | Hornung et al. | 52/786.13 |
| 2009/0044467 | A1 * | 2/2009 | Krochmal et al. | 52/204.593 |
| 2009/0113826 | A1 * | 5/2009 | Abdul Lathief | 52/214 |
| 2009/0139163 | A1 * | 6/2009 | Prete et al. | 52/204.593 |
| 2009/0139164 | A1 * | 6/2009 | Prete et al. | 52/204.593 |
| 2009/0139165 | A1 * | 6/2009 | Prete et al. | 52/204.593 |
| 2010/0031591 | A1 * | 2/2010 | Gallagher | 52/204.591 |
| 2010/0180504 | A1 * | 7/2010 | Kernaghan et al. | 49/50 |

* cited by examiner (detail A)

WINDOW ASSEMBLIES INCLUDING BRONZE ELEMENTS

This application claims priority to, the benefit of, and incorporates herein by reference U.S. application Ser. No. 61/647,796, filed May 16, 2012

BACKGROUND OF INVENTION

The fenestration industry dates from antiquity and mankind has used many methods of securing the openings in buildings that provide light, air and access. After the invention of steel and the methods of readily producing clear glass were developed it became commonplace to enclose openings by means of slender steel framework that held glass panels by means of clips and glazing putty. This allowed for a higher level of shelter to be constructed. Windows made from steel and glass allowed natural light while providing protection from the elements and this paved the way to control indoor temperature. The invention of air conditioning induced a further need to control air infiltration, radiant energy and thermal transfer and consequently steel window production slowly gave way to more energy efficient methods of construction. This transition significantly altered the architectural style that had been established with the low profile steel windows. The applicants present invention allows for the architectural style established with the narrow sight lines of steel windows with a maintenance free window that has the thermal performance required in modern construction.

BRIEF DESCRIPTION OF THE INVENTION

Applicant has created a window typically constructed, in one embodiment, primarily from bronze and brass extrusions with a profile similar to the old fashioned steel windows, that can be dry glazed and with a design that helps reduce thermal transfer through the frame and provides for the use of monolithic or insulated glass. This window system, with the unique single or double glass retainer attachment, as well as novel devices and method of securing the units into a building structure, allows for integration into the modern building envelope, providing the necessary barrier against moisture, air infiltration and solar energy while maintaining the distinctive architectural style of a bygone era.

DETAILED DESCRIPTION OF PREFERRED EMBODIMENT

Figure 1:
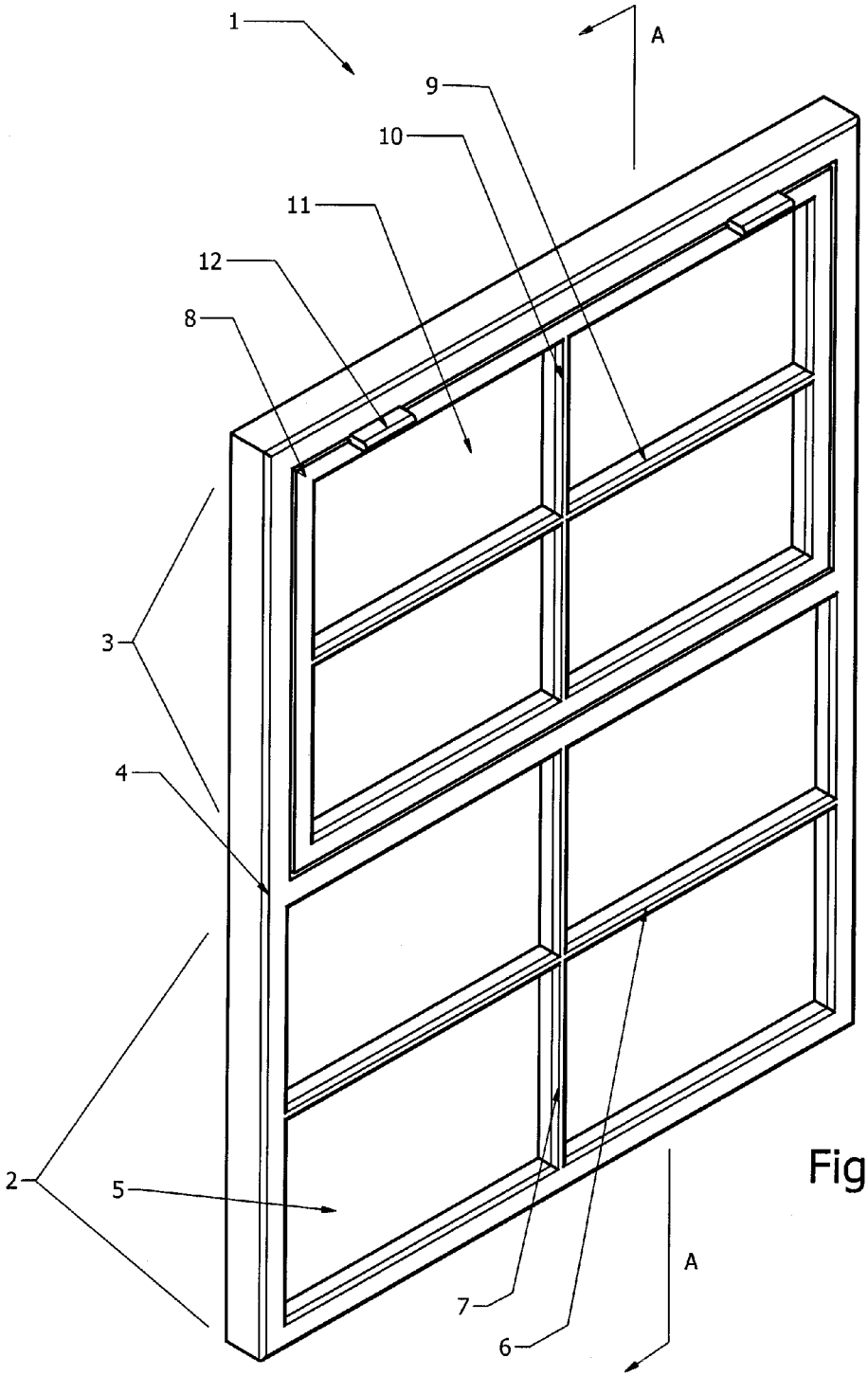
FIG. 1 is a perspective view of a typical window including an operational and fixed glass portion. The cutaway section line A-A is the vantage point of the other figures.
Figures 2A, 2B, 2C, 2D, 2E:
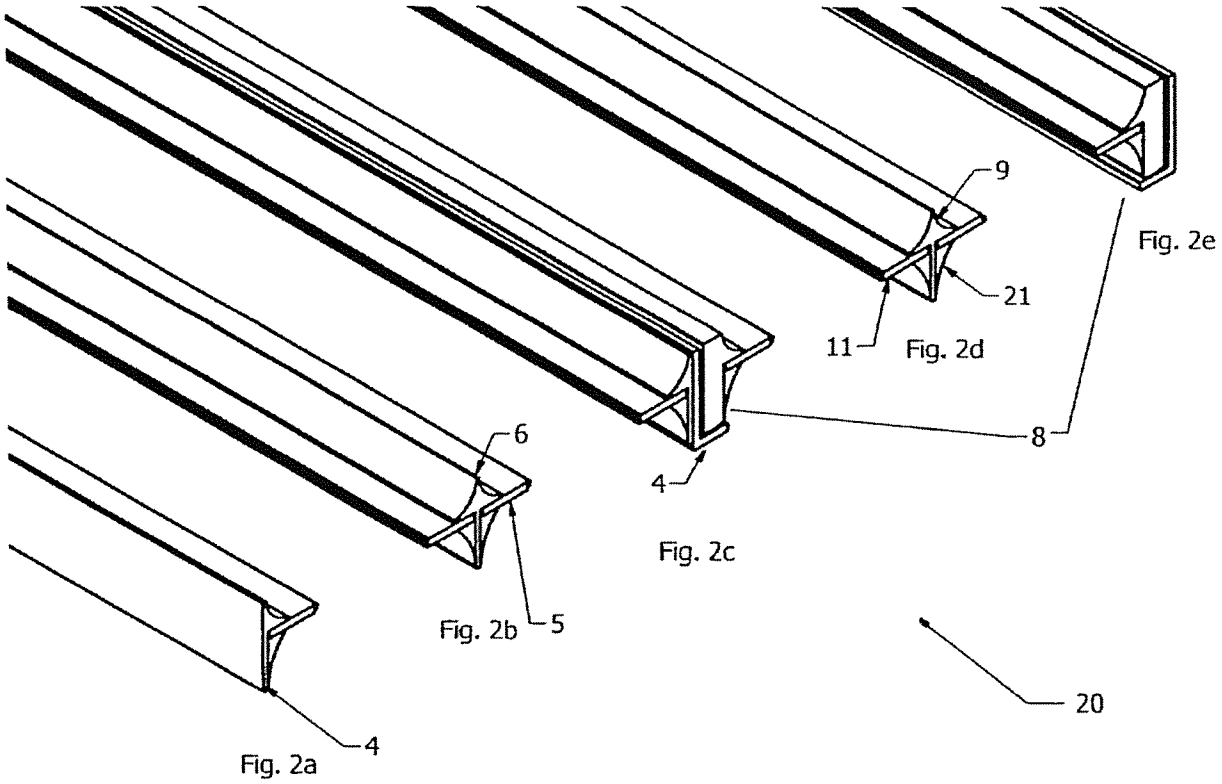
Figure 2a-2e Prior Art
FIGS. 2*a*-2*e* portray a cutaway section views of a traditional prior art steel window that was regularly glazed with a single layer of glass.

Turning to FIG. 1, we see Mulled Window (1) comprised of a Fixed Window (2) and Operating Window (3), joined by common Outside Frame (4). Typically, Fixed Glass (5) is set directly into Frame (4) of Fixed Window (2), although interrupted by Fixed Horizontal Muntin Bar (6) and Vertical Fixed Muntin Bar (7). Active Sash (8) is operably connected to Outside Frame (4) by means of Hinge (12), and supports Horizontal Active Muntin Bar (9) and Vertical Active Muntin Bar (10), which together holds the Sash Glass (11). Of course there are many different configurations that windows can be arranged in, and this drawing is to illustrate the basic parts of one embodiment of the windows in discussion.

In FIGS. 2*a*-2*e*, we see the Steel Cross Section (20) which is a typical detail of existing art. More specifically we see Steel Cross Section (20) has many of the same components as the Mulled Window (1) of FIG. 1, including the Outside Frame (4), Fixed Glass (5), Horizontal Fixed Muntin Bar (6), Active Sash (8), Horizontal Active Muntin Bar (9) and Sash Glass (11). Further we see Fixed Glass (5) and Sash Glass (11) may be single pane glass and are secured with Glazing Putty (21) which is inserted to seal the edges. Also of note is that the Horizontal Fixed Muntin Bars (6), Outside Frame (4), Horizontal Active Muntin Bar (9) and Active Sash (8) are all constructed of monolithic pieces of metal which readily transmit heat.

Figure 3A:
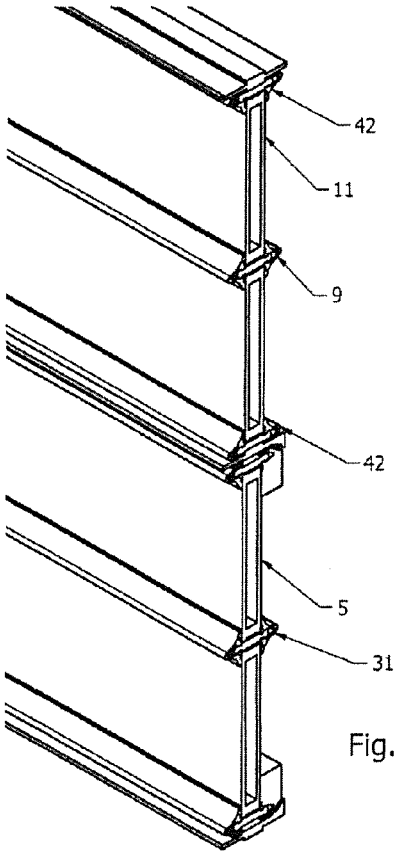
FIGS. 3*a*-3*c* are cutaway section views of applicant's present invention and displays the unique double glass retainers and the dry glazing seal details.
Figure 3C:
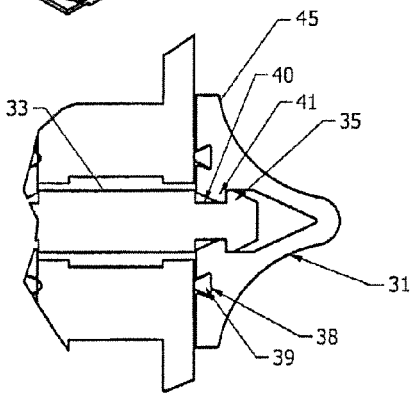
Figure 3B:
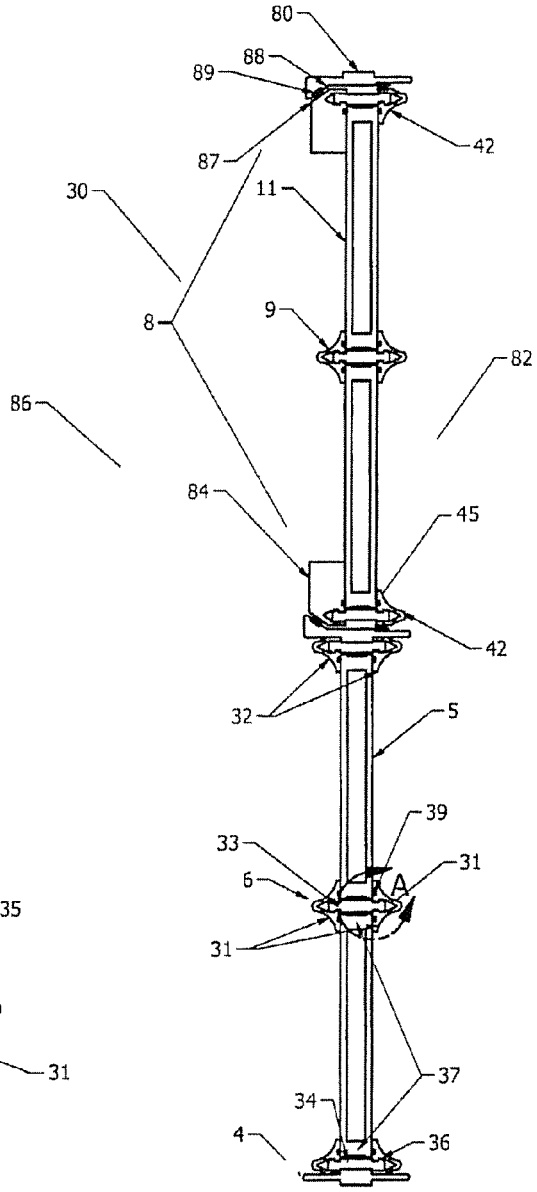

FIGS. 3*a*, 3*b* and 3*c* details Bronze Cross Section (30), which is a typical detail of applicants present invention. In the Bronze Cross Section (30) there are also the components listed in the Mulled Window (1) of FIG. 1, including the Outside Frame (4), Fixed Glass (5), Horizontal Fixed Muntin Bar (6), Active Sash (8), Horizontal Active Muntin Bar (9) and Sash Glass (11). A distinguishing feature of the applicant's present invention is the double Muntin Snap Joints (35) and Perimeter Snap Joints (36) which have a Snap Attachment Channel (40) and engage corresponding Attachment Clip Ridge (41) on the Arm Extension (45) of the Snap Joints (35) and (36), the Attachment Clip Ridge (41) and Snap Attachment Channel (40) are formed by contouring the wall of Double Muntin Retainers (31) and double Perimeter Retainers (32) and Muntin Base (33) and Perimeter Base (34) respectively. So as the window is constructed, the Double Muntin Retainers (31) and Double Perimeter Retainers (32) are affixed to the Muntin Base (33) and Perimeter Base (34), respectively, and are fastened together at Muntin Snap Joints (35) and Perimeter Snap Joints (36), forming a Glazing Channel (37) to support the glass. It will be noted that Glazing Channel can optionally provide for Sealant Groove (38) to house Glazing Gasket (39) which eliminates the need for glass to be set in a wet bed of sealant, and replaces the Glazing Putty (21) FIG. 2 in the prior art. It is also noted that the Fixed Glass (5) and Sash Glass (11) are double pane, or insulated glass, although it could be constructed with single pane glass in the same manner. The Muntin Base (33) and Perimeter Base (34) are typically constructed of a non-metallic material or different density metal coated so as to reduce thermal conductivity, and consequently significantly increasing the insulating properties of the window. Further it can be seen on Bronze Cross Section (30) that Outside Frame (4) is comprised of Active Sash Perimeter Frame (80) at Operating Window (3) for operable attachment to Active Sash (8). Further, the geometry of Active Sash (8) allows for uniformity between Active Perimeter Retainer (42) and the double Perimeter Retainers (32) when viewed from Exterior Face (82). Support Frame (84) can be seen on Interior Face (86) and provides strength and a place to mount commercially available locking hardware. Outside Edge (57) of Active Sash Perimeter Frame (80) is closely contoured to correspond with Inside Edge (88) of Active Sash Perimeter Frame (80), and Weather Stripping (89) is used to seal between Active Sash (8) and Active Sash Perimeter Frame (80).

Figures 4A, 4B:
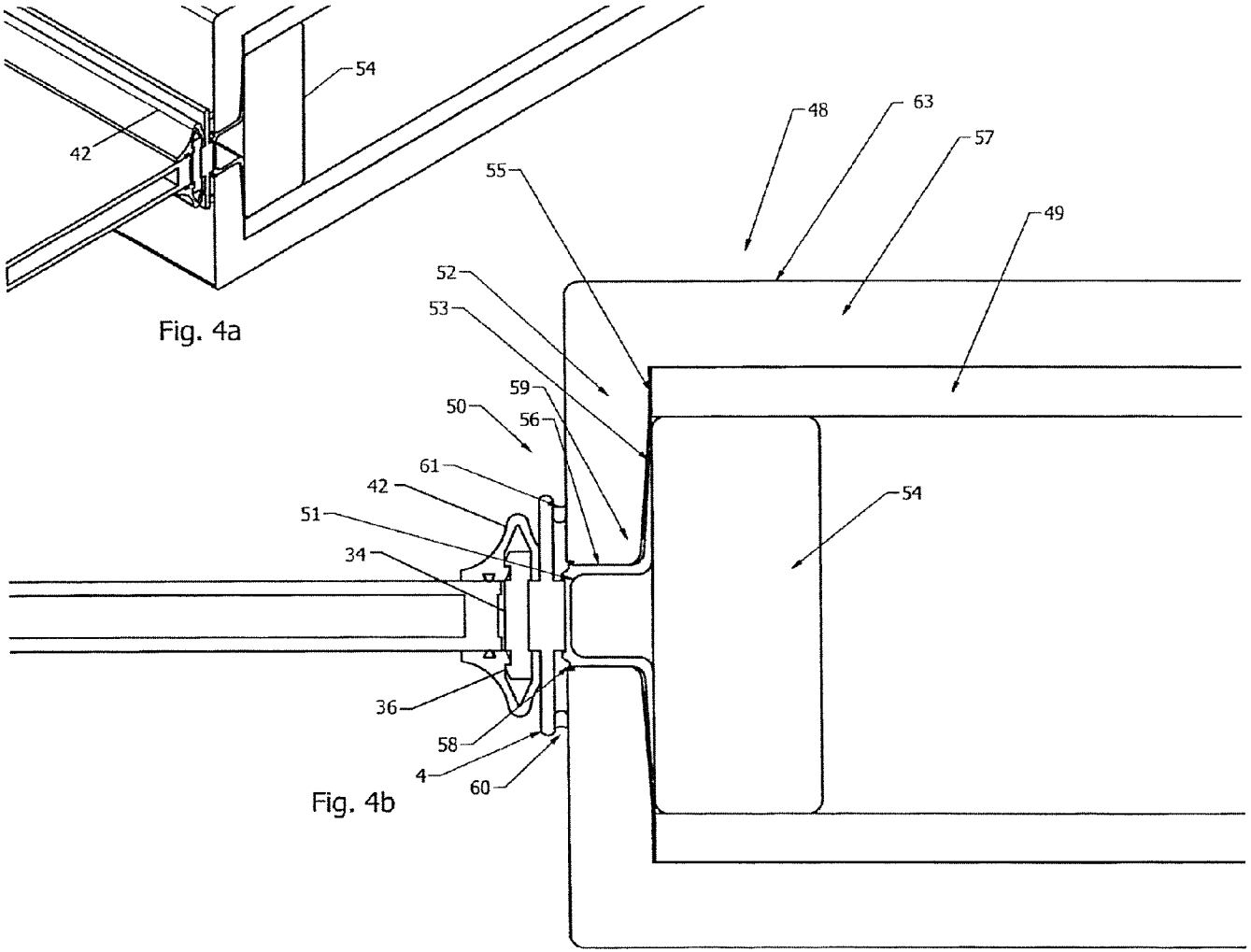
FIGS. 4*a* and 4*b* are cutaway perimeter detail sections of the unique plaster flange attachment method of applicant's present invention that allows for the antique architectural style of setting the windows in the center of a thick masonry covered wall and yet still provide for the moisture barrier required in modern construction.

FIGS. 4*a* and 4*b*, detail Fixed Plaster Flange (50) a cut-away section of Outside Frame (4) with the unique Plaster Flange (51) attached to outside frame (4) and mounted in Structural Wall (48) that is clad with Sheathing (49) such as OSB board. It is noted that Outward Edge (53) is affixed to the Building Structure (54), which can be a 2×4 or any such structural member, and provides a surface for Waterproofing Membrane (55) which can be Tyvek or any suitable building waterproofing membrane, to seal against. Reinforced Plaster (57) can then wrap around Building Structure (54) as a Plaster Return (52) stopping at Plaster Termination (59) as defined by Plaster Pocket Forming Member (56). This allows Plaster Return (52) sufficient thickness to be structurally sound and Trowel Guide (58) forms a utility point to guide the masons trowel as the plaster is applied. Of course, the plaster is referred to as a means of illustration but any exterior building material such as stone or wood could be used instead of the plaster. Once applied, Reinforced Plaster (57), or any whatever building material used to clad the structure, forms one side of the Caulk Channel (60) where Flexible Caulk (61) is applied to form an additional seal against moisture penetration. Thus applicant has demonstrated how the unique Fixed Plaster Flange (50) allows for windows to be installed inset from the Outside Face (63) of Structural Wall (48), allow for the thickness of Plaster Return (52) by means of Plaster Pocket Forming Member (56) and still maintain a complete seal between Outside Frame (4) and Structural Wall (48).

Figures 5A, 5B:
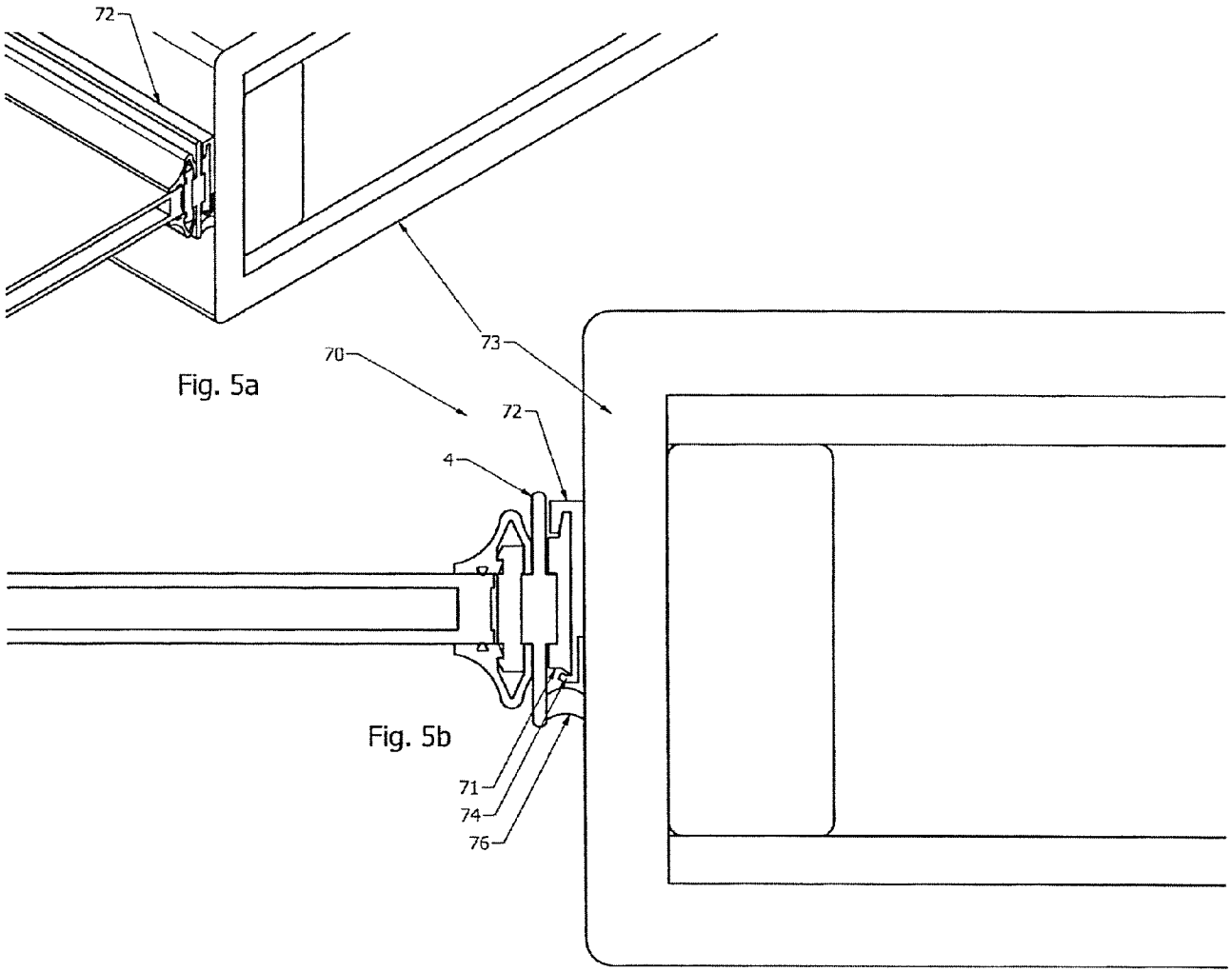
FIGS. 5*a* and 5*b* shows cutaway perimeter detail sections of an alternate attachment method of applicant's present invention that allows for retrofitting existing steel windows.

FIGS. 5*a* and 5*b*, Replacement Frame (70) is a cut-away section of Outside Frame (4) with alternate Remodel Flange (71). In practice, Setting Block (72) is fastened to Existing Wall (73) and Remodel Flange (71) is connected the Setting Block (72) by means of Clip (74). Frame is sealed into Existing Wall (73) by means of Flexible Caulk (76).

Figure 6:
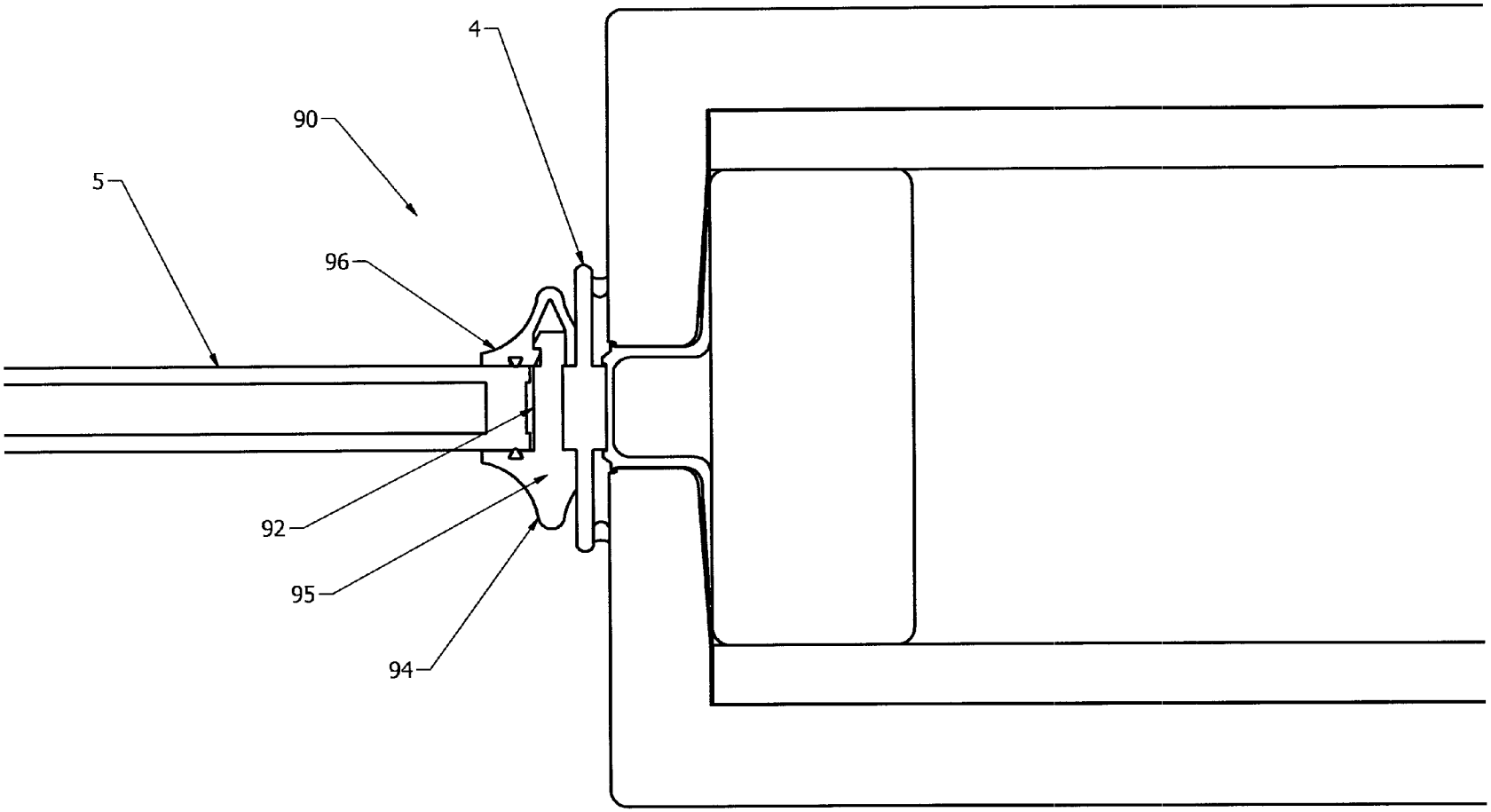
FIG. 6 is a top view cutaway perimeter detail section of a stationary window where the perimeter base is combined into a single piece with one of the retainers, allowing for increased manufacturing efficiencies.

FIG. 6 is a cut-away section of the Alternate Bronze Frame (90), which is an alternate design detail of applicant's present invention. The Alternate Bronze Frame (90) includes some of the components listed in the Mulled Window (1) of FIG. 1, including the Outside Frame (4), Fixed Glass (5). The distinguishing feature of the applicant's alternate configuration is the combination of Alternate Perimeter Base (92) and Inside Perimeter Stop (94) into a one piece Perimeter Retainer Base (95). Perimeter Retainer (96) is then applied to Perimeter Retainer Base (95) to secure the glass. The utility of this can be applied to Active Sash (8) and Muntin Bar (6) on FIG. 3.

Although the invention has been described with reference to a specific embodiment, the description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A window for engagement with a building structure having a window opening, the window comprising:

a perimeter frame adapted to engage the window opening of the structure;

at least one window pane having a window pane perimeter, an outer pane surface, and an inner pane surface;

multiple perimeter retainer members, each of the multiple perimeter retainer members including an outer perimeter retainer member and an inner perimeter retainer member, each of the outer perimeter retainer members and the inner perimeter retainer members having opposed substantially flat walls configured to engage the outer pane surface and the inner pane surface, respectively, and an attachment clip ridge;

a perimeter clip member configured with a first end and a second end, at least the first end adapted to resiliently insert into and engage at least one of the attachment clip ridges of one of the perimeter retainer members and a the second end to engage the attachment clip ridges of another of the perimeter retainer members so as to maintain the perimeter retainer members in a spaced apart relation with the substantially flat walls thereof flush against the window pane perimeter;

a resilient sealing member adapted to engage the substantially flat walls of the retainer members to seal the retainer members against the window pane; and wherein the perimeter frame is adapted to engage the perimeter clip member so as to hold the inner and outer perimeter retainer members fixedly adjacent the frame.

2. The window of claim 1, wherein the pane is a multiplicity of panes and further comprising muntin members, the muntin members comprising an outer muntin retainer member and an inner muntin retainer member, the muntin retainer members each having a pair of laterally spaced apart, opposed, substantially flat facing walls configured to engage a perimeter of a first pane of the multiplicity of panes and a perimeter of a second adjacent pane of the multiplicity of panes, the outer and inner muntin retainer members including muntin clip engaging walls centrally located between the pair of laterally spaced facing walls;

a muntin clip member having a first end and a second end, at least the first end adapted to resiliently engage the muntin clip engaging walls of one of the muntin retainer members and the second end to engage the other of the muntin retainer members so as to maintain the flat facing walls snugly against the inner and outer pane surfaces of the adjacent panes; and resilient sealing members adapted to engage the flat walls of the retainer members to seal the retainer members against the perimeters of the adjacent window panes.

3. The window of claim 2, wherein the second end of the perimeter clip member is integral with one of the perimeter retainer members.

4. The window of claim 2, wherein the first and second ends of the perimeter clip member are adapted to resiliently engage the outer and inner perimeter retainer member.

5. The window of claim 2, wherein the outer and inner perimeter and muntin retainer members are bronze.

6. The window of claim 2, wherein the perimeter frame defines a mulled window having a fixed window and an operating window.

7. The window of claim 2, wherein the substantially flat walls of the perimeter and muntin retainer members include channels adapted to engage the resilient sealing member.

8. The window of claim 2, further including a mounting flange adapted to allow the window to be set in from a face of a support wall, the flange providing a surface to apply waterproof membrane to seal the window.

9. The window of claim 8, further including a trowel guide on the mounting flange.

10. The window of claim 8, further including a caulking channel for application of flexible sealant between the support wall and the perimeter frame.

11. The window of claim 1, further including a setting block that is attachable to an existing wall and to the perimeter clip members.

* * * * *